US011723511B2

(12) United States Patent
Woo et al.

(10) Patent No.: US 11,723,511 B2
(45) Date of Patent: Aug. 15, 2023

(54) DISHWASHER AND CONTROLLING METHOD THEREFOR

(71) Applicant: LG Electronics Inc., Seoul (KR)

(72) Inventors: Sangwoo Woo, Seoul (KR); Kitae Kwon, Seoul (KR); Minchul Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/523,322

(22) Filed: Jul. 26, 2019

(65) Prior Publication Data

US 2020/0029783 A1 Jan. 30, 2020

(30) Foreign Application Priority Data

Jul. 26, 2018 (KR) ..... 10-2018-0087039

(51) Int. Cl.
*A47L 15/46* (2006.01)
*A47L 15/00* (2006.01)
(Continued)

(52) U.S. Cl.
CPC ..... *A47L 15/46* (2013.01); *A47L 15/0084* (2013.01); *A47L 15/4202* (2013.01);
(Continued)

(58) Field of Classification Search
CPC ..... A47L 15/0036; A47L 15/4234; A47L 15/4289; A47L 2501/05; A47L 15/4214;
(Continued)

(56) References Cited

U.S. PATENT DOCUMENTS 1,404,804 A * 1/1922 Stevens ..... F16K 15/04 280/834
2014/0283880 A1* 9/2014 Kim ..... A47L 15/0047 134/25.2
(Continued)

FOREIGN PATENT DOCUMENTS

AU 2018202053 10/2018
EP 2818091 12/2014
(Continued)

OTHER PUBLICATIONS

Australian Office Action in Australian Application No. 2019208259, dated Mar. 25, 2020, 3 pages.
(Continued)

*Primary Examiner* — Spencer E. Bell
(74) *Attorney, Agent, or Firm* — Fish & Richardson P.C

(57) ABSTRACT

A method for controlling a dishwasher includes: supplying washing water to a sump; rotating an impeller disposed in a washing pump by a washing motor so that the washing water flows into the washing pump from the sump;
operating a heater disposed in the washing pump so as to heat the washing water existing in the washing pump and generate steam to supply to a steam nozzle; and supplying the washing water or steam in the washing pump to the steam nozzle by rotating the impeller at a second set rotational speed lower than a first set rotational speed by the washing motor. The method further includes closing a selector valve, configured to open and close a path between the washing pump and the steam nozzle, when the impeller rotates at the first set rotational speed or higher.

15 Claims, 12 Drawing Sheets

(51) Int. Cl.
*A47L 15/42* (2006.01)
*A47L 15/50* (2006.01)

(52) U.S. Cl.
CPC ..... *A47L 15/428* (2013.01); *A47L 15/4217* (2013.01); *A47L 15/4234* (2013.01); *A47L 15/4248* (2013.01); *A47L 15/4289* (2013.01); *A47L 15/502* (2013.01); *A47L 2501/05* (2013.01); *A47L 2501/06* (2013.01)

(58) Field of Classification Search
CPC ..... A47L 15/4219; A47L 15/4221; A47L 15/4225; A47L 2501/14
See application file for complete search history.

(56) References Cited

U.S. PATENT DOCUMENTS

| | | | | |
|---|---|---|---|---|
| 2017/0188778 | A1* | 7/2017 | Kim | A47L 15/4225 |
| 2017/0188781 | A1 | 7/2017 | Lee et al. | |
| 2017/0196432 | A1* | 7/2017 | Kim | A47L 15/4289 |

FOREIGN PATENT DOCUMENTS

| | | |
|---|---|---|
| EP | 3560406 | 10/2019 |
| WO | WO2017022976 | 2/2017 |

OTHER PUBLICATIONS

Extended European Search Report in European Application No. 19188309.9, dated Jan. 8, 2020, 8 pages.

* cited by examiner

DISHWASHER AND CONTROLLING METHOD THEREFOR

CROSS-REFERENCE TO RELATED APPLICATIONS

This application claims priority to Korean Application No. 10-2018-0087039, filed on Jul. 26, 2018, the contents of which are hereby incorporated by reference in its entirety.

BACKGROUND OF THE INVENTION

1. Field of the invention

The present invention relates to a dishwasher and a control method thereof, and more particularly, to a dishwasher for spraying washing water and steam to wash dishes or cooking utensils, and a control method thereof.

2. Description of the Related Art

A dishwasher is a household appliance for washing dirt such as food wastes on dishes or cooking utensils (hereinafter, referred to as 'washing target') by high-pressure washing water sprayed from a spray arm.

The dishwasher generally includes a tub forming a washing chamber and a sump mounted in the bottom of the tub to store the washing water. The washing water is moved to the spray arm by the pumping action of a washing pump mounted inside the sump, and the washing water moved to the spray arm is sprayed at a high pressure through a spray hole formed in the spray arm. Then, the washing water sprayed at a high pressure impinges against the surface of the washing target, so that the dirt on the washing target drops to the bottom of the tub.

Meanwhile, the dishwasher may perform cleaning or sterilization by using the heated washing water to wash the washing target or to supply steam to the washing target.

Publicized patent KR20160000564A discloses that a plurality of steam nozzles disposed in the front and rear sides connected to the washing pump are included, and steam is selectively or simultaneously supplied to the plurality of steam nozzles. Further, it discloses that an impeller existing in the washing pump is driven to supply steam to a plurality of spray nozzles.

In the above described related art, since a steam outlet provided to the steam nozzle is disposed below the impeller of the washing pump, steam can be supplied to the steam nozzle in a state where the impeller does not operate. Therefore, the impeller does not operate in the process of continuously supplying steam to the steam nozzle. If this process is continued, the reliability of the heater may be deteriorated due to overheating of the heater.

SUMMARY OF THE INVENTION

The present invention has been made in view of the above problems, and provides a dishwasher for generating and supplying steam while preventing overheating of a heater, and a control method thereof.

The present invention further provides a dishwasher for controlling the supply of washing water or steam to a spray nozzle or a steam nozzle to increase the washing efficiency, and a control method thereof.

The present invention further provides a dishwasher for directly utilizing steam sprayed from a steam nozzle.

The present invention further provides a dishwasher in which steam generated from a washing pump is supplied to a steam nozzle as much as possible, and a control method thereof.

In accordance with an aspect of the present invention, a method of controlling a dishwasher, including the steps of: (a) a water supply step of supplying washing water to a sump; (b) rotating an impeller disposed in a washing pump by a washing motor so that the washing water flows into the washing pump from the sump; (c) a first steam nozzle supplying step of operating a heater disposed in the washing pump so as to heat the washing water existing in the washing pump and generate steam to supply to a steam nozzle; and (d) a second steam nozzle supplying step of supplying the washing water or steam in the washing pump to the steam nozzle by rotating the impeller at a second set rotational speed lower than a first set rotational speed by the washing motor, wherein a selector valve that opens and closes between the washing pump and the steam nozzle is closed, when the impeller rotates at the first set rotational speed or higher.

The step (b) is a spray nozzle supplying step of rotating the impeller at the first set rotational speed by the washing motor so that the washing water stored in the sump is introduced to the inside of the washing pump and sent to at least one of a plurality of spray nozzles.

In the step (b), the heater disposed in the washing pump is operated to heat the flowing washing water.

The steps (b) and (c) are repeatedly performed.

The plurality of spray nozzles are vertically disposed and, in the step (b), the washing pump is connected to all of the plurality of spray nozzles.

The method further includes a stopping step (e) of stopping the operation of the heater and the washing motor, between the step (c) and the step (d).

In the step (c), the washing motor rotates the impeller at the second set rotational speed.

In the step (d), the operation of the heater disposed in the washing pump is stopped.

The step (c) and the step (d) are repeatedly performed.

The plurality of spray nozzles are vertically disposed and, in the step (d), the washing pump is connected to a spray nozzle disposed in an uppermost end among the plurality of spray nozzles.

In accordance with another aspect of the present invention, a dishwasher includes: a tub that accommodates a washing target; a plurality of spray nozzles that spray washing water into the tub and are vertically disposed; a sump that stores washing water; a washing pump that includes an impeller for pumping the washing water stored in the sump and a washing motor for rotating the impeller; a heater that heats the washing water existing in the washing pump; a steam nozzle that sprays washing water or steam heated by the heater into the tub; a steam supply pipe connecting the washing pump and the steam nozzle; a selector valve that is disposed in the steam supply pipe, blocks the flow of washing water when the washing motor rotates the impeller at a first set rotational speed or higher, and allows the flow of washing water or steam when the washing motor rotates the impeller at a second set rotational speed lower than the first set rotational speed; and a controller that controls the washing motor and the heater.

The controller stops the washing motor or rotating the impeller at the second set rotational speed by the washing motor, when the heater is operated to supply steam or high-temperature washing water generated in the washing pump to the steam nozzle.

The dishwasher further includes a switching valve for selectively connecting the washing pump with at least one of the plurality of spray nozzles, wherein the controller controls the switching valve to connect the washing pump to a spray arm disposed in an uppermost end of a plurality of spray arms, when generating steam by the heater.

The controller temporarily stops operation of the heater, when supplying steam or high temperature washing water generated in the washing pump by operation of the heater to the steam nozzle.

The controller operates the washing motor so that the impeller rotates at the second set rotational speed or lower, and repeatedly performs a process of stopping the washing motor, when supplying steam or high temperature washing water generated in the washing pump by operation of the heater to the steam nozzle.

The controller rotates the impeller at the first set rotational speed by the washing motor, when supplying washing water in the washing pump to at least one of the plurality of spray nozzles.

The dishwasher further includes: a first rack that is disposed in the tub and holds a washing target washed with the washing water sprayed through the plurality of spray nozzles; and a second rack that is disposed inside the tub in a direction in which steam is sprayed from the steam nozzle, and holds a washing target washed with the steam or high temperature washing water sprayed through the steam nozzle.

BRIEF DESCRIPTION OF THE DRAWINGS

The above and other objects, features and advantages of the present invention will be more apparent from the following detailed description in conjunction with the accompanying drawings, in which:

FIG. 7A illustrates an example of an opened state, and FIG. 7B illustrates an example of a closed state;

DETAILED DESCRIPTION OF THE PREFERRED EMBODIMENTS

Exemplary embodiments of the present invention are described with reference to the accompanying drawings in detail. The same reference numbers are used throughout the drawings to refer to the same or like parts. Detailed descriptions of well-known functions and structures incorporated herein may be omitted to avoid obscuring the subject matter of the present invention.

Hereinafter, the present invention will be described with reference to the drawings for explaining a dishwasher and a control method thereof according to embodiments of the present invention.

<Overall Configuration>

Figure 1:
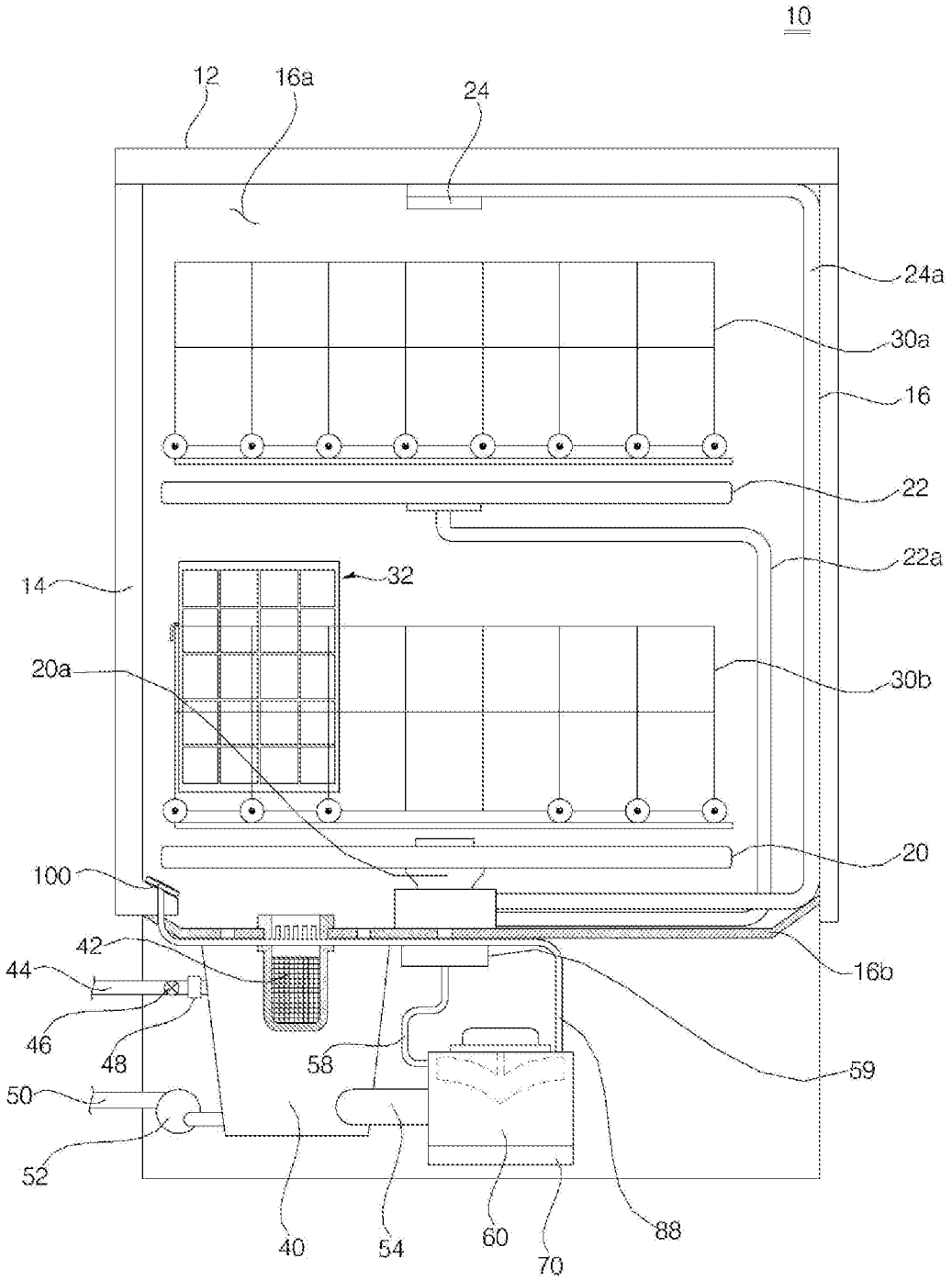
FIG. 1 is a schematic structural view of a dishwasher according to an embodiment of the present invention.
Figure 2:
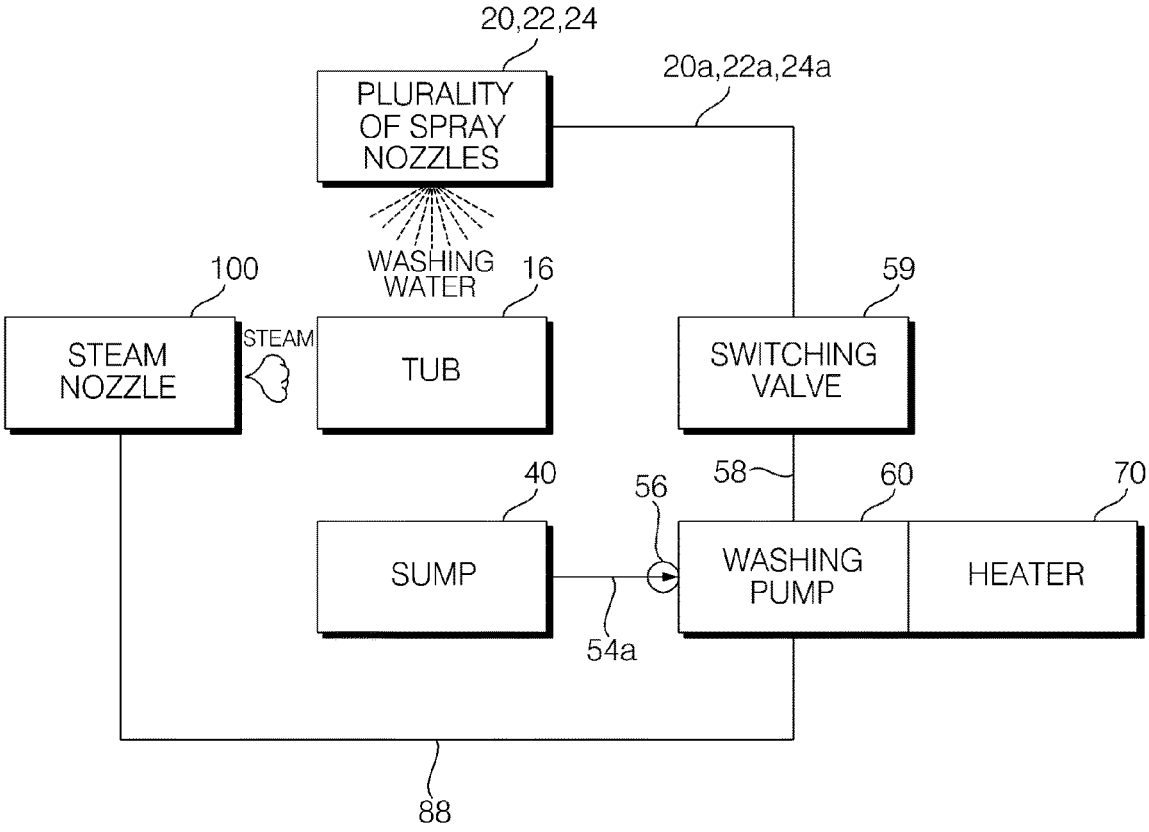
FIG. 2 is a configuration diagram of a dishwasher according to an embodiment of the present invention.

FIG. 1 is a schematic structural view of a dishwasher according to an embodiment of the present invention. FIG. 2 is a configuration diagram of a dishwasher according to an embodiment of the present invention.

Hereinafter, the entire configuration of the dishwasher according to the embodiment of the present invention will be briefly described with reference to FIGS. 1 and 2.

A dishwasher 10 according to the present embodiment includes a case 12 forming an outer shape of the dishwasher 10, a tub 16 forming a washing chamber 16*a* that is provided in the case 12 and accommodates a washing target, a door 14 that is provided in the front surface of the tub 16 and opens and closes the washing chamber 16*a*, and a sump 40 that is disposed below the tub 16 and stores washing water.

The sump 40 according to the present embodiment may be provided with a filter 42 for filtering the washing water supplied from the outside or the washing water introduced from the tub 16.

The dishwasher 10 according to the present embodiment includes a plurality of spray nozzles 20, 22, and 24 for spraying washing water into the washing chamber 16*a* inside the tub 16, a washing pump 60 for supplying the washing water stored in the sump 40 to the plurality of spray nozzles 20, 22, and 24, a switching valve 59 for connecting the washing water supplied from the washing pump 60 to at least one of the plurality of spray nozzles, and a rack 30, 32 for holding a washing target in the tub 16.

The rack 30, 32 according to the present embodiment includes a first rack 30 for holding the washing target so as to wash the washing target by the washing water sprayed by the plurality of the spray nozzles 20, 22, and 24, and a second rack 32 for holding the washing target which is washed by steam or high-temperature washing water sprayed by the steam nozzle 100. The first rack 30 may include an upper rack 30*a* disposed in the upper side based on a disposed position inside the washing chamber 16*a* and a lower rack 30*b* disposed in the lower side.

The plurality of spray nozzles 20, 22, and 24 may be disposed in the vertical direction. The plurality of spray nozzles 20, 22, and 24 according to the present embodiment includes a lower spray nozzle 20 that is disposed in the lowermost end and sprays washing water from the lower side to the upper side toward the lower rack 30*b*, an upper spray nozzle 22 that is disposed between the upper rack 30*a* and the lower rack 30*b* and sprays washing water toward the upper rack 30*a* or the lower rack 30*b* and the upper rack 30*a*, and a top spray nozzle 24 disposed in an upper end of the washing chamber 16*a* which is the upper side of the upper rack 30*a* and spraying washing water into a space of the washing chamber 16*a*. The plurality of spray nozzles 20, 22, and 24 may be supplied with the washing water from the washing pump 60 through a plurality of spray nozzle connecting pipes 20*a*, 22*a*, and 24*a*.

The switching valve 59 may selectively supply the washing water pumped by the washing pump 60 to at least one of the lower spray nozzle 20, the upper spray nozzle 22, and the top spray nozzle 24. The switching valve 59 may selectively connect a washing water supply pipe 58 through which the washing water discharged from the washing pump 60 flows to at least one of the plurality of spray nozzle connecting pipes 20*a*, 22*a*, and 24*a*.

The washing pump 60 may be connected to the sump 40 through a water collecting pipe 54 in which a water collecting flow path is formed. A check valve 56 for opening and closing a connection between the sump 40 and the washing pump 60 may be disposed in the water collecting pipe 54 or the inlet of the washing pump 60.

The check valve according to the present embodiment may be opened when the washing pump 60 is operated to flow the washing water, and may be closed when the washing pump 60 stops and the washing water does not flow. The check valve may be opened by the flow pressure of the washing water of the washing pump 60. However, the above-mentioned check valve is just an example, and the check valve can be constituted by a solenoid valve which is opened or closed by an electronic signal.

The dishwasher 10 according to the present embodiment may include a water supply assembly for supplying washing water into the dishwasher and a drain assembly for draining water stored inside the dishwasher. The water supply assembly according to the present embodiment includes a water supply pipe 44 forming a water supply flow path for supplying washing water from an external water source, a water supply valve 46 for opening and closing a water supply flow path formed in the water supply pipe 44, and a flow meter 48 for measuring the flow rate of the washing water flowing to the sump 40 through the water supply flow path.

The drain assembly according to the present embodiment may include a drain pipe 50 in which a drain flow path for guiding the water stored in the sump 40 to the outside is formed, and a drain pump 52 which is disposed in the drain flow path formed in the drain pipe 50, and drains the washing water in the sump 40 to the outside. The drain pump 52 may include a drain motor (not shown) for generating a rotational force.

<Washing Pump/Selector Valve>

Figure 3:
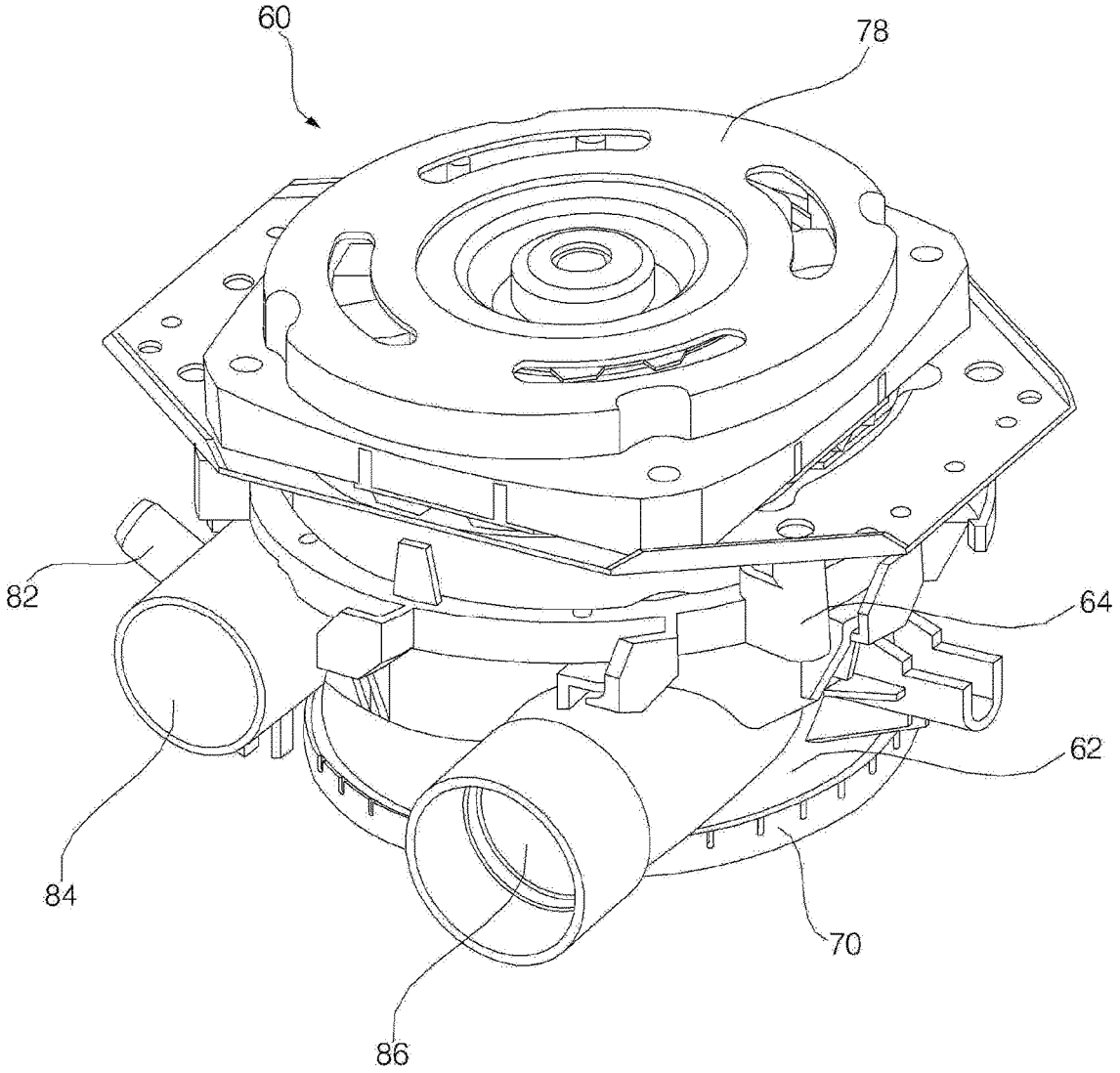
FIG. 3 is a perspective view of a washing pump according to an embodiment of the present invention.
Figure 4:
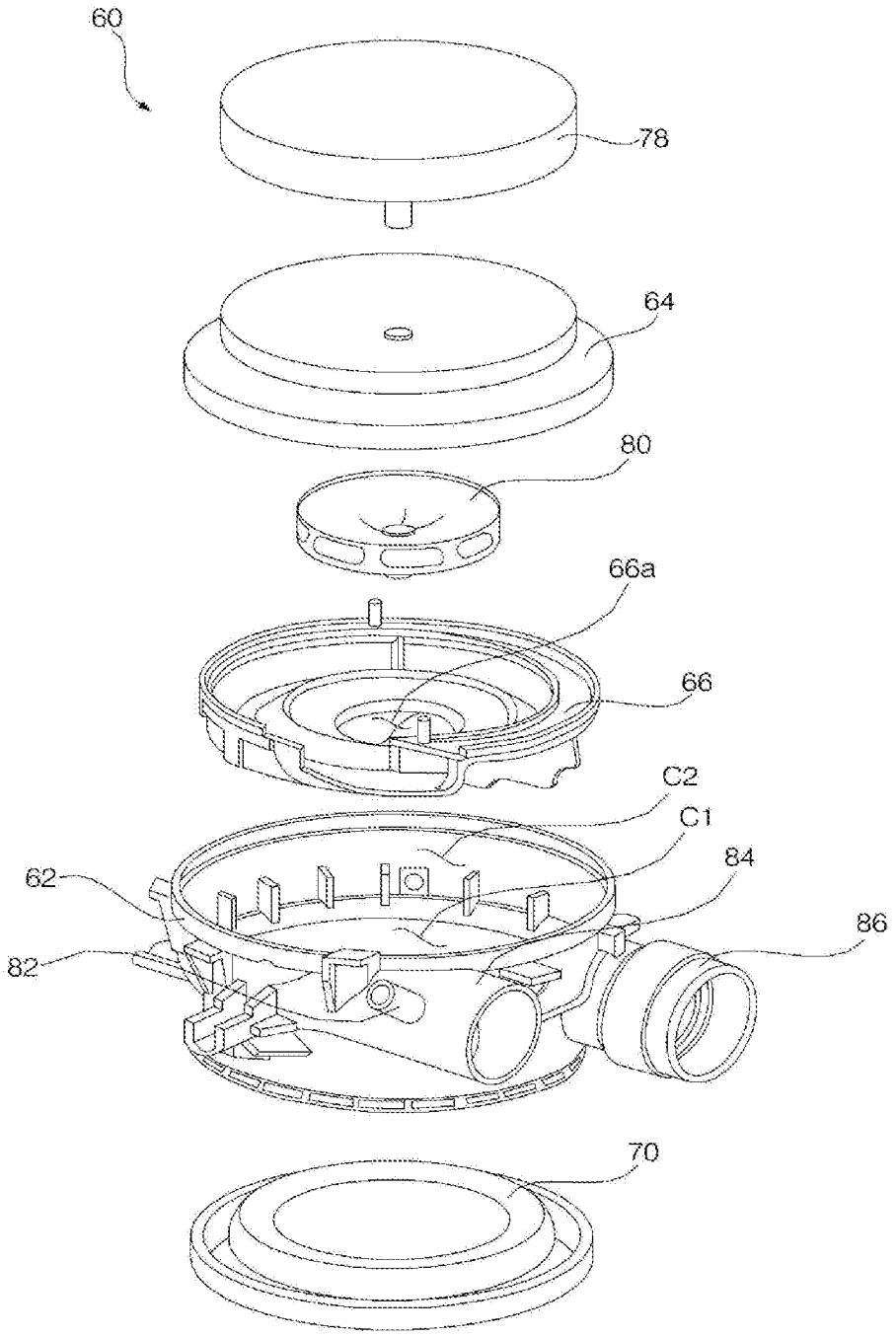
FIG. 4 is an exploded perspective view of a washing pump according to an embodiment of the present invention.
Figure 5:
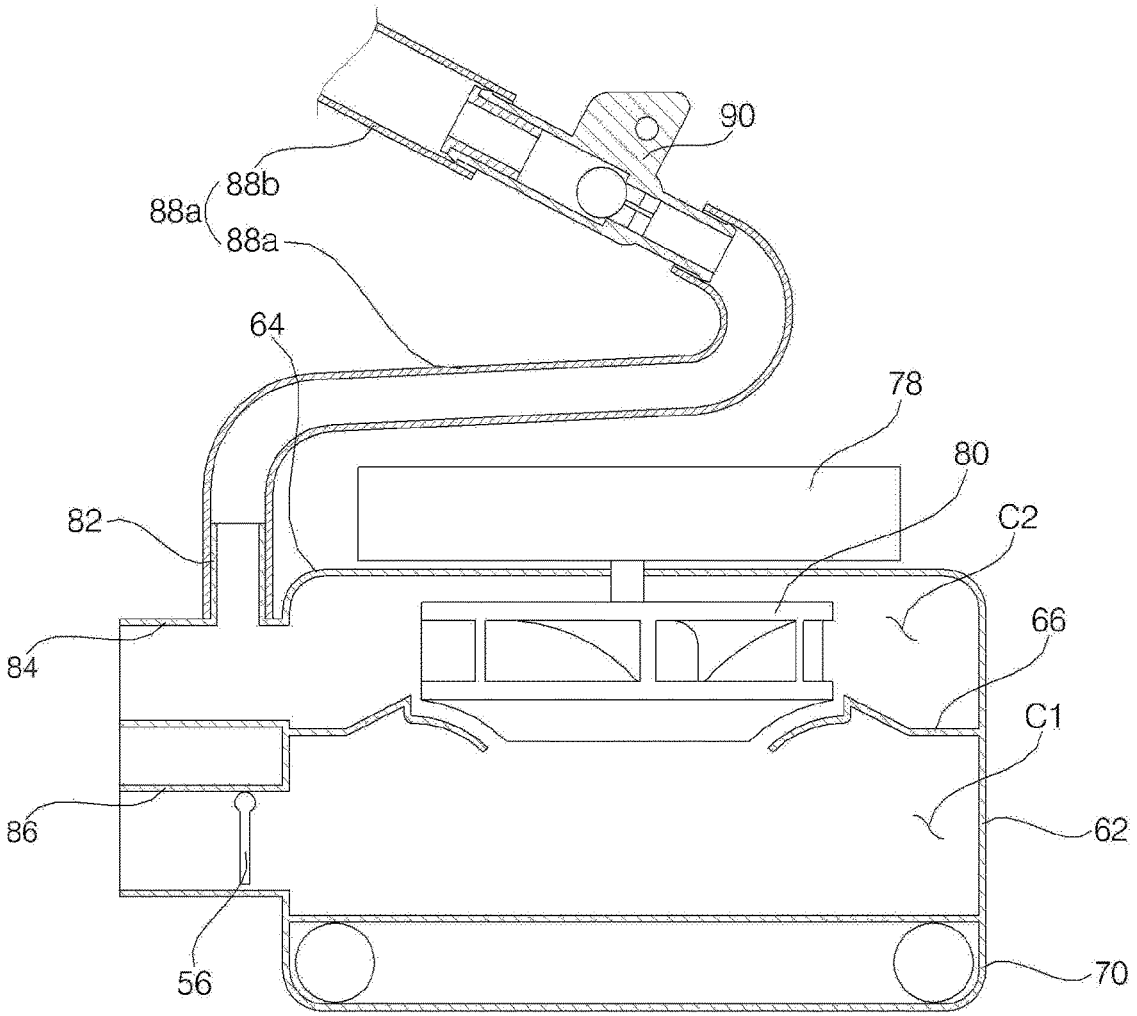
FIG. 5 is a schematic cross-sectional view of a washing pump according to an embodiment of the present invention.
Figure 6:
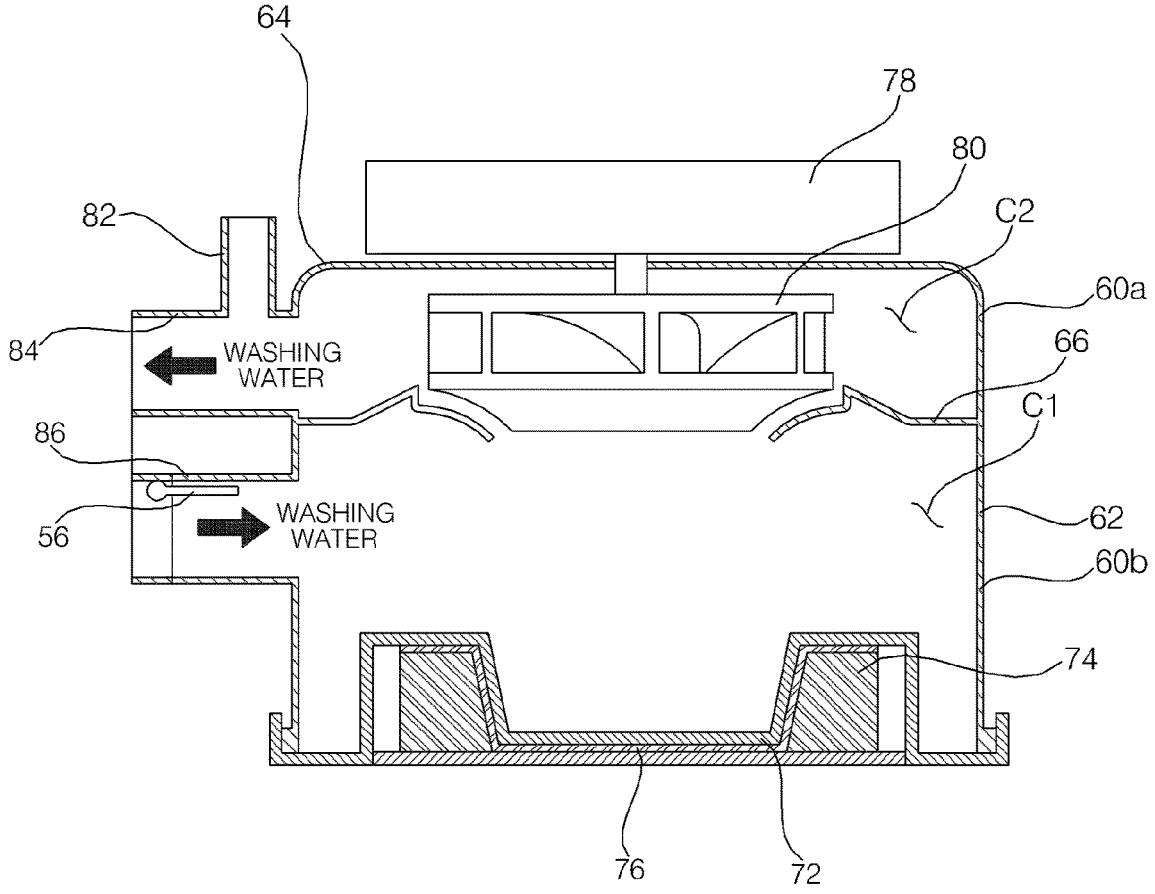
FIG. 6 is a schematic cross-sectional view illustrating a connection between a washing pump and a selector valve according to an embodiment of the present invention.
Figure 7A:
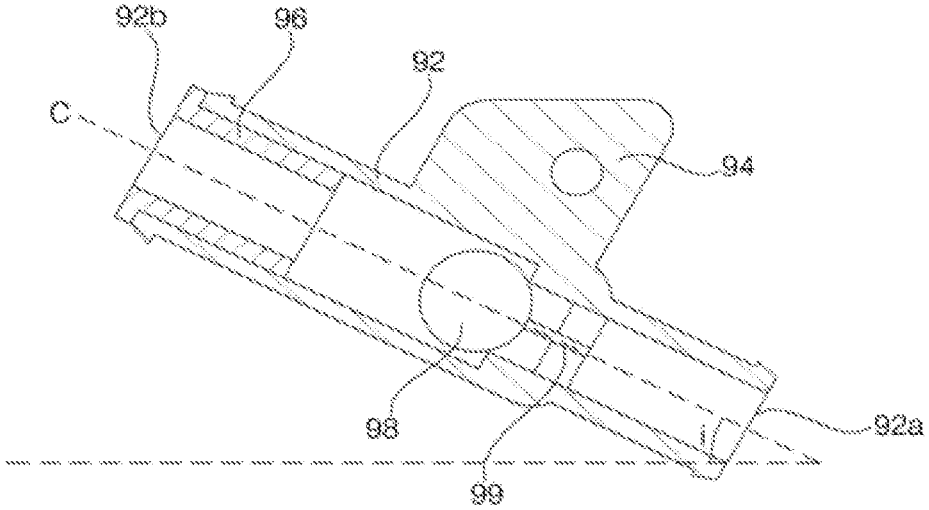
FIGS. 7A and 7B are schematic cross-sectional views of a selector valve for explaining opening/closing of a selector valve according to an embodiment of the present invention.
Figure 7B:
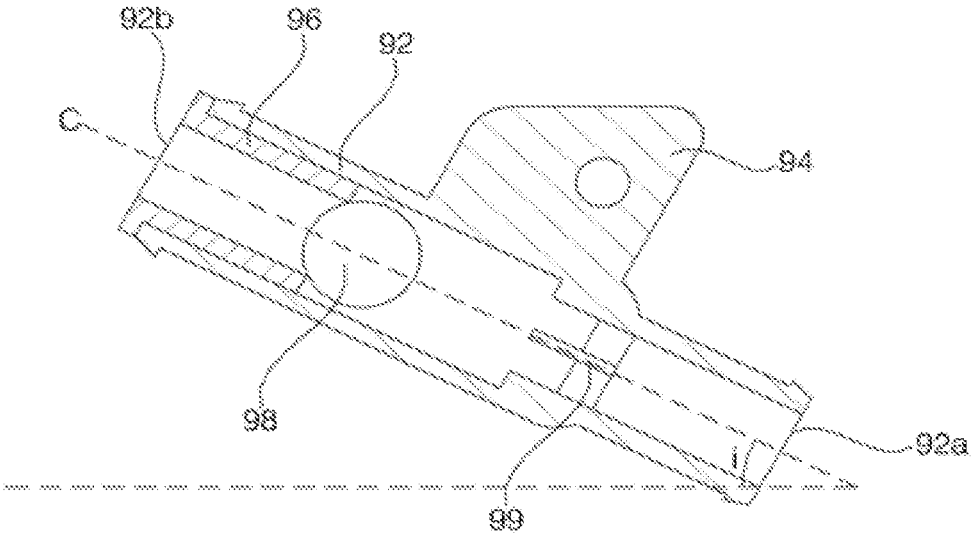

FIG. 3 is a perspective view of a washing pump according to an embodiment of the present invention. FIG. 4 is an exploded perspective view of a washing pump according to an embodiment of the present invention. FIG. 5 is a schematic cross-sectional view of a washing pump according to an embodiment of the present invention. FIG. 6 is a schematic cross-sectional view illustrating a connection between a washing pump and a selector valve according to an embodiment of the present invention. FIGS. 7A and 7B are schematic cross-sectional views of a selector valve for explaining opening/closing of a selector valve according to an embodiment of the present invention. FIG. 7A illustrates an example of an opened state, and FIG. 7B illustrates an example of a closed state.

Hereinafter, specific configuration and arrangement of the washing pump and the selector valve according to the embodiment of the present invention will be described with reference to FIGS. 3 to 7B.

The washing pump 60 according to the present embodiment may supply water stored in the sump 40 to the plurality of spray nozzles 20, 22 and 24, or generate steam to send to the steam nozzle 100. The washing pump 60 according to the present embodiment is connected to the sump 40 through the water collecting pipe 54. The washing pump 60 according to the present embodiment is connected to the switching valve 59 and the spray nozzle through the washing water supply pipe 58 and may be connected to the steam nozzle 100 through a steam supply pipe 88.

The washing pump 60 according to an embodiment of the present invention includes a housing 62 that is coupled to the sump 40 and forms an external shape, an impeller 80 that is disposed inside the housing 62 and forms a flow of washing water or steam disposed inside the housing 62, a washing motor 78 that rotates the impeller 80, and a heater 70 that generates steam by heating washing water in the housing 62.

The housing 62 according to the present embodiment may be provided with a washing water inflow pipe 86 which forms an inflow port so that the washing water of the sump 40 flows into the housing 62 by the rotation of the impeller 80, a washing water outflow pipe 84 which forms an outflow port so that the washing water inside the housing 62 is supplied to the plurality of spray nozzles 20, 22 and 24, and a steam discharge pipe 82 which is disposed in the washing water outflow pipe 84 and forms a steam discharge port through which the steam generated by the heater 70 is discharged.

The washing water inflow pipe 86 may be disposed in a lower portion of the circumferential surface of the housing 62, and the washing water outflow pipe 84 may be disposed in an upper portion of the circumferential surface of the housing 62.

The housing 62 may be formed in a cylindrical shape having open top and bottom surfaces. A housing cover 64 is coupled to the upper end of the housing 62, and the heater 70 is coupled to the lower end thereof. The housing cover 64 may cover the open upper portion of the housing 62. The washing motor 78 for generating a rotational force to rotate the impeller 80 may be disposed in the upper side of the housing cover 64.

Inside the housing 62, a partition wall 66 dividing the inner space of the housing 62 into upper and lower parts is disposed. The partition wall 66 according to the present embodiment may be disposed below the impeller 80. The partition wall 66 may be disposed in the upper side of the washing water inflow pipe 86 and disposed in the lower side of the washing water outflow pipe 84. The partition wall 66 may divide the inside of the housing 62 into a lower chamber C1 and an upper chamber C2. The lower chamber C1 is a place where the negative pressure is generated by the rotation of the impeller 80, and the upper chamber C2 is a place where the positive pressure is generated by the rotation of the impeller 80.

The lower chamber C1 is connected to the sump 40 through the water collecting pipe 54 and the washing water inflow pipe 86. The upper chamber C2 is connected to the switching valve 59 through the washing water outflow pipe 84 and the washing water supply pipe 58. The steam discharge pipe 82 formed in one side of the washing water outflow pipe 84 may be connected to the steam nozzle 100 through the steam supply pipe 88.

The washing pump 60 may be divided, based on the partition wall 66, into a pump lower portion 60*a* through which the washing water is introduced by the rotation of the impeller 80, and a pump upper portion 60*b* through which the washing water is discharged by the rotation of the impeller 80.

The lower chamber C1 is formed inside the pump lower portion 60*a*, and the upper chamber C2 is formed inside the pump upper portion 60*b*. In the pump lower portion 60*a*, the washing water inflow pipe 86 and the heater 70 are disposed.

The washing water outflow pipe 84 and the steam discharge pipe 82 are disposed in the pump upper portion 60*b*. The housing cover 64 is disposed in the pump upper portion 60*b*. In the pump upper portion 60*b*, the impeller 80 is disposed inside the housing 62 and the washing motor 78 is disposed in the upper side of the housing 62.

The partition wall 66 is formed with a partition hole 66*a* for communicating the lower chamber C1 with the upper chamber C2. The upper surface of the partition wall 66 is formed in a volute shape so that the washing water introduced into the upper chamber C2 through the partition hole 66*a* from the lower chamber C1 may be guided to the washing water outflow pipe 84. A lower surface of the partition wall 66 may be formed with a guider (not shown) protruding downward. The guider of the partition wall 66 may guide the washing water introduced into the lower chamber C1 to the partition wall hole 66*a* through the washing water inflow pipe 86. The guider of the partition wall 66 allows the washing water in the lower chamber C1 to be uniformly heated by the heater 70.

The impeller 80 is rotated by the washing motor 78 to flow washing water or steam in the housing 62 and discharge it to the outside. The impeller 80 is rotatably disposed in the upper chamber C2. The impeller 80 may transfer the washing water or steam introduced into the upper chamber C2 from the lower chamber C1 through the partition wall hole 66*a* to the washing water outflow pipe 84 or the steam discharge pipe 82.

The washing water inflow pipe 86 is connected to the lower chamber C1 side of the housing 62. The washing water inflow pipe 86 is connected to the water collecting pipe 54 so that the washing water of the sump 40 can be introduced into the lower chamber C1. The washing water inflow pipe 86 is disposed to protrude from the lower portion of the circumference surface of the housing 62.

The washing water outflow pipe 84 is connected to the upper chamber C2 side of the housing 62. The washing water outflow pipe 84 is connected to the washing water supply pipe 58 so that the washing water in the upper chamber C2 can be discharged to the washing water supply pipe 58. The washing water outflow pipe 84 is disposed to protrude outward from the upper portion of the circumference surface of the housing 62.

The steam discharge pipe 82 is connected to the upper chamber C2 side of the housing 62. The steam discharge pipe 82 may be disposed in various positions of the housing 62 so as to connect the upper chamber C2 of the housing 62 with the steam supply pipe 88. In the present embodiment, the steam discharge pipe 82 is disposed in the washing water discharge pipe 84. The pipe direction of steam discharge pipe 82 according to the present embodiment is disposed to be inclined in such a manner that the steam discharge direction is inclined upward. The steam discharge direction of the steam discharge pipe 82 may be perpendicular to the discharge direction of the washing water of the washing water discharge pipe 84.

The steam discharge pipe 82 discharges the steam or the high-temperature washing water generated inside the housing 62 by the heater 70 to the steam supply pipe 88. The steam supply pipe 88 is connected to the upper chamber C2 through the steam discharge pipe 82.

The heater 70 is connected to the lower end of the housing 62 and forms the bottom surface of the housing 62. The heater 70 may heat the washing water flowing inside the housing 62 and generate the high-temperature washing water or steam. When the heater 70 heats the washing water inside the housing 62, the impeller 80 can be rotated or stopped. The heater 70 is disposed below the washing water inflow pipe 86. The heater 70 is disposed below the partition wall 66. A part of the heater 70 is disposed inside the housing 62.

The check valve 56 according to the present embodiment is disposed in the washing water inflow pipe 86. The upper end of the check valve 56 is coupled to the upper end of the washing water inflow pipe 86. The check valve 56 may be opened when the impeller 80 rotates, and may be closed when the impeller 80 does not rotate. The check valve 56 may be opened during operation of the washing motor 78, and closed during the stop of the washing motor 78. The check valve 56 may be closed during the steam generation of the heater 70 to prevent the steam generated inside the housing 62 from flowing out to the sump 40 through the lower chamber C1 and the washing water inflow pipe 86.

The check valve 56 may be configured to allow washing water to flow from the wash pump 60 to the sump 40 during operation of the drain pump 52. The check valve 56 may be formed in such a manner that a part of the lower portion of the washing water inflow pipe 86 is opened when the check valve 56 is closed. The check valve 56 is formed to cover 50% to 90% of the cross-sectional area of the washing water inflow pipe 86 when the check valve 56 is closed, and is preferably formed to cover 70% of the cross-sectional area of the washing water inflow pipe 86.

The check valve 56 may be closed to prevent the washing water and steam from flowing to the sump 40 from the washing pump 60 during steam generation of the heater 70. However, the check valve 56 may be opened by the flow pressure of the washing water when the impeller 80 rotates, during steam generation of the heater 70.

When the drain pump 52 and the washing motor 78 are stopped (when not operated), the check valve 56 stores the washing water inside the housing 62.

The heater 70 according to an embodiment of the present invention includes a heater cover 72 that forms a bottom surface of the housing 62, a heating element 74 joined to the lower side of the heater cover 72 to heat the heater cover 72, and a heater plate 76 which is joined to the lower side of the heater cover 72 and transfers the heat generated by the heating element 74 to the heater cover 72. Unlike the present embodiment, the heater plate 76 can be disposed below the heater.

The heater 70 according to the present embodiment includes a thermostat (not shown) for supplying power to the heating element 74 and adjusting the temperature of the heating element 74, a wire (not shown) for electrically connecting the heating element 74 and the thermostat, and a heater shield (not shown) for covering a part of the heater plate 76 from below.

The dishwasher 10 according to the present embodiment is provided with the steam supply pipe 88 connecting the steam nozzle 100 and the washing pump 60, and a selector valve 90 that is disposed in the steam supply pipe 88, blocks the outflow of the washing water exceeding a first set pressure, and permits the discharge of the washing water or steam having a second set pressure or lower.

The steam discharge pipe 82 according to the present embodiment connects the housing 62 of the washing pump 60 and the steam supply pipe 88. The steam supply pipe 88 according to the present embodiment connects the steam discharge pipe 82 and the steam nozzle 100. The steam supply pipe 88 according to the present embodiment may be provided with the selector valve 90 for opening and closing the flow of the steam supplied to the steam nozzle 100 or the high-temperature washing water. The steam supply pipe 88 according to the present embodiment may include a first steam supply pipe 88*a* for connecting the steam discharge pipe 82 and the selector valve 90, and a second steam supply pipe 88*b* for connecting the selector valve 90 and the steam nozzle 100.

The selector valve 90 is opened and closed so that high-temperature washing water or steam having the second set pressure SP2 or lower discharged from the steam discharge pipe 82 is allowed to flow into the steam supply pipe 88, and the washing water having the first set pressure SP1 flowed to the steam discharge pipe 82 is prevented from being discharged to the steam supply pipe 88.

The internal flow path of the selector valve 90 is opened, when the washing water or the steam having the second set pressure SP2 or lower is introduced or in a normal state (when the washing motor is not operated), and is closed when the washing water exceeding the first set pressure is introduced. The inlet of the selector valve 90 is disposed to be lower than the outlet thereof. At this time, the inlet is the side from which the steam or washing water is introduced, and the outlet is the side to which steam is discharged. The inlet of the selector valve 90 is connected to the first steam supply pipe 88*a* and the outlet thereof is connected to the second steam supply pipe 88*b*.

The selector valve 90 according to an embodiment of the present invention includes a valve body 92 in which a flow path is formed, a fixing portion 94 for fixing the arrangement of the valve body 92, a valve seat 96 disposed in an outlet 92*b* side of the valve body 92, and a valve ball 98 disposed inside the valve body 92 and contacting the valve seat 96 to close the flow path of the valve body 92.

In the present embodiment, the valve body 92 is formed in a cylindrical shape having a flow path formed therein. Both ends of the valve body 92 is opened to form an inlet 92*a* through which washing water or steam introduced and an outlet 92*b* through which steam is discharged. The valve body 92 is disposed in such a manner that the pipe direction C is inclined upward. That is, the inlet 92*a* of the valve body 92 is disposed lower than the outlet 92*b*.

The pipe direction C of the valve body 92 may have an angle (i) that is an acute angle with respect to the horizontal direction. When the angle (i) is 0 degree, the pipe direction C of the valve body 92 becomes the horizontal direction, so that the inlet of the valve seat 96 can be closed by the valve ball 98 when stem is generated, which is not desirable. In addition, when the angle i is 45 degrees or more, the RPM of the washing motor 78 should be excessively high so that the inlet of the valve seat 96 is closed by the valve ball 98, which is not desirable.

The angle i may be formed in a range of 15 to 30 degrees, considering the pressure of the washing water flowing into the selector valve 90 when the impeller 80 is rotated by the washing motor 78.

The valve seat 96 is inserted and coupled to the outlet 92*b* side of the valve body 92. The valve ball 98 is accommodated inside the valve body 92.

A plurality of valve ribs 99 in which the valve ball 98 is seated are formed inside the inlet side of the valve body 92. Each of the plurality of valve ribs 99 protrudes radially from the inner surface of the valve body 92. The longitudinal direction of each of the plurality of valve ribs 99 is disposed in the pipe direction of the valve body 92 and the height direction is disposed in the radial direction of the valve body 92.

The plurality of valve ribs 99 are disposed spaced apart in the circumferential direction of the valve body 92. At least one upper end of the plurality of valve ribs 99 is in contact with the valve ball 98 when no washing water flows into the inside of the valve body 92.

On the outer surface of the valve body 92, the fixing portion 94 for fixing the arrangement of the valve body 92 is formed. The fixing portion 94 according to the present embodiment can be coupled to one side of the sump 40. The fixing portion 94 may be coupled with a sump coupling portion (not shown) formed in the sump 40 by a bolt (not shown).

The valve seat 96 is formed in a cylindrical shape and inserted into the outlet 92*b* of the valve body 92. The valve seat 96 may be formed of rubber or plastic of a soft material. The lower end of the valve seat 96 is in close contact with the valve ball 98 when the washing water having the first set pressure SP1 or more flows into the valve body 92. The inlet of the valve seat 96 is closed by the valve ball 98 when the washing water having the first set pressure SP1 or more is introduced.

The valve ball 98 is movably disposed inside the valve body 92. The valve ball 98 moves between the upper end of the plurality of valve ribs 99 inside the valve body 92 and the inlet of the valve seat 96. The diameter of the valve ball 98 is smaller than the inner diameter between the upper end of the plurality of valve ribs 99 inside the valve body 92 and the inlet of the valve seat 96. The diameter of the valve ball 98 is larger than the inner diameter of the valve seat 96. The diameter of the valve ball 98 is larger than the length of a line connecting the inner upper ends of any two of the plurality of valve ribs 99. The valve ball 98 is formed of a steel material.

Referring to FIG. 7A, when the steam flows into the valve body 92 or the washing water having the second set pressure or lower is introduced, the valve ball 98 is in contact with the plurality of valve ribs 99 due to its own weight, or is in contact with at least one of the plurality of valve ribs 99 and the inner surface of the valve body 92. In addition, when the washing water having the second set pressure or lower is introduced, the valve ball 98 may not abut against both the plurality of valve ribs 99 and the valve seat 96.

The steam introduced into the valve body 92 or the washing water having the second set pressure SP2 or lower passes the space between the plurality of valve ribs 99 and the space between the valve ball 98 and the inner surface of the valve body 92, and is discharged from the valve body 92 to the steam supply pipe 88.

Referring to FIG. 7B, when the washing water exceeding the first set pressure flows into the inside of the valve body 92, the valve ball 98 is in contact with the inlet of the valve seat 96 due to the flow pressure of the washing water or the buoyancy. When the washing water exceeding the first set pressure is introduced, the valve ball 98 closes the inlet of the valve seat 96 to close the flow path of the valve body 92. The washing water exceeding the first set pressure introduced into the valve body 92 is not discharged from the valve body 92 to the steam supply pipe 88.

The first set pressure SP1 and the second set pressure SP2 may be determined according to the rotational speed of the impeller 80. The first set pressure SP1 may be formed with a value higher than the second set pressure SP2. The first set pressure SP1 and the second set pressure SP2 may be numerical values in consideration of the self weight of the valve ball 98.

Thus, the valve ball 98 is spaced apart from the inlet of the valve seat 96 in the case of the second set pressure SP2 or lower below the self weight of the valve ball 98, and the valve ball 98 can be brought into close contact with the inlet of the valve seat 96 in the case of the first set pressure SP1 or higher exceeding the self weight of the valve ball 98.

The first set pressure SP1 and the second set pressure SP2 may be replaced by the first set rotational speed SRS1 and the second set rotational speed SRS2 of the impeller 80. Thus, when the washing motor 78 of the washing pump 60 is operated at the first set rotation speed SRS1 or higher, the pressure of the washing water flowing into the valve body 92 of the selector valve 90 is formed to be the first set pressure SP1 or higher, so that the selector valve 90 can be closed. Further, when the washing motor 78 of the washing pump 60 is operated at the second set rotational speed SRS2 or lower, the pressure of the washing water flowing into the valve body 92 of the selector valve 90 becomes the second set pressure SP2 or lower, so that the selector valve 90 can be opened.

<Second Rack>

Figure 8:
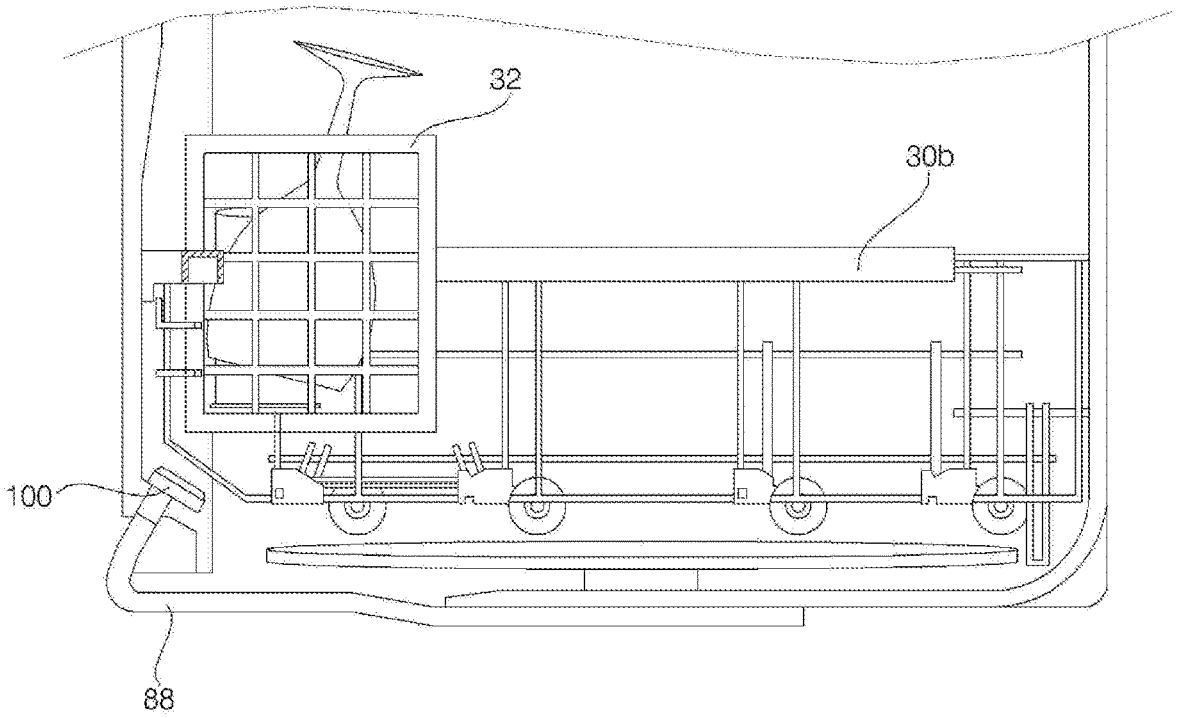
FIG. 8 is a schematic cross-sectional view of a dishwasher having a second rack according to an embodiment of the present invention.
Figure 9:
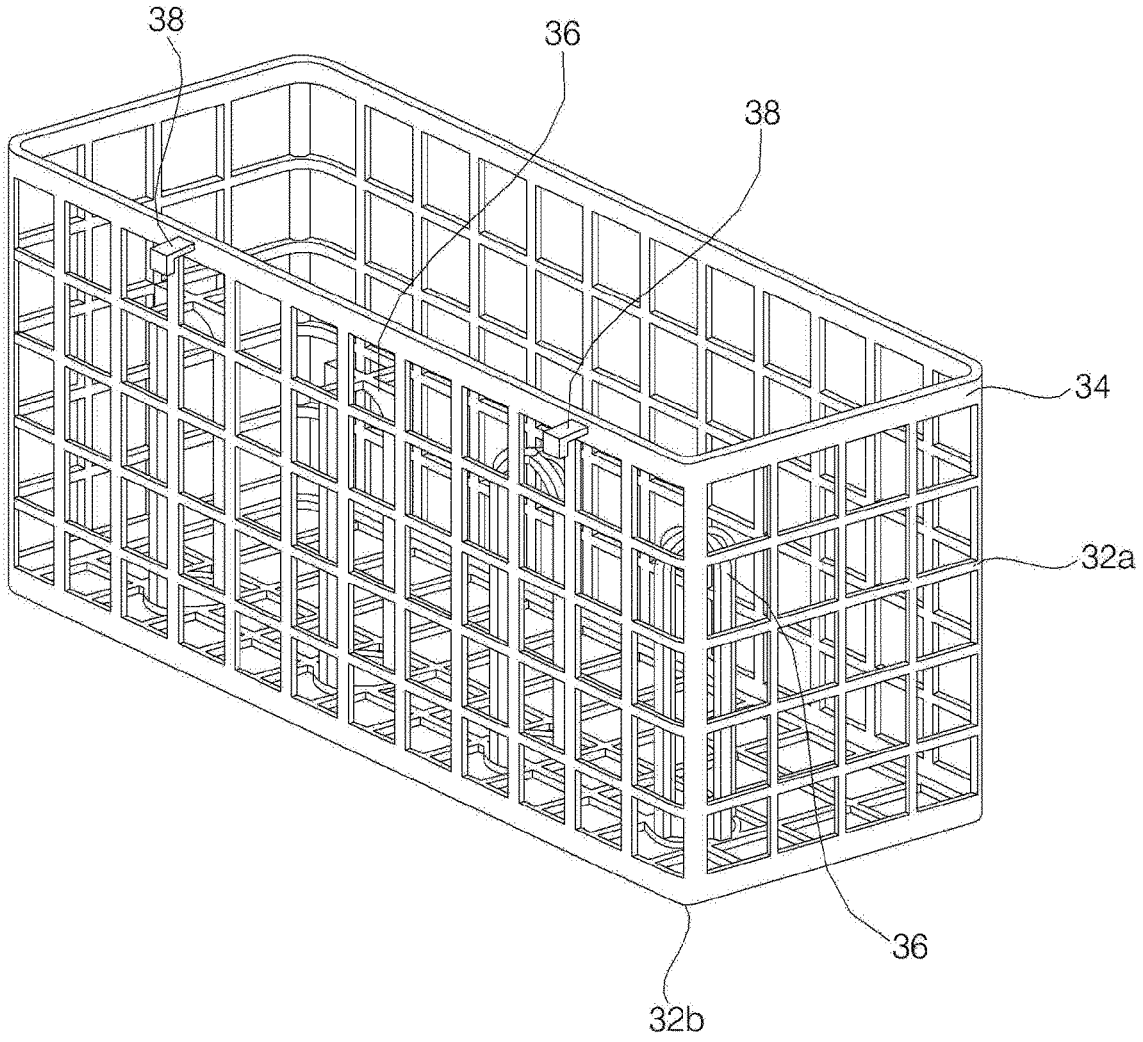
FIG. 9 is a perspective view of a second rack according to an embodiment of the present invention.

FIG. 8 is a schematic cross-sectional view of a dishwasher having a second rack according to an embodiment of the present invention. FIG. 9 is a perspective view of a second rack according to an embodiment of the present invention.

Hereinafter, the arrangement and configuration of the second rack according to the embodiment of the present invention will be described with reference to FIGS. 8 to 9.

The second rack 32 prepares a space for holding dishes to be steam-washed by using steam sprayed from the steam nozzle 100. The second rack 32 according to the present embodiment has a box shape having an opened upper side. The second rack 32 may be disposed in a direction in which the steam is sprayed from the steam nozzle 100. The second rack 32 according to the present embodiment is disposed in the direction in which the steam is sprayed from the steam nozzle 100, and may wash the hold dishware through concentrated spraying of steam.

The upper surface of the second rack 32 is opened, and an outer wall frame 34 having a lattice shape is formed in the circumferential surface 32*a* and the lower surface 32*b*. Thus, the washing water or steam can flow into the second rack 32 through the outer wall frame 34 having a lattice shape formed in the circumferential surface 32*a* and the lower surface 32*b*.

The second rack 32 includes an outer wall frame 34 forming a circumferential surface 32*a* and a bottom surface 32*b*, and a support frame 36 supporting the tableware which is hold inside a space formed by the outer wall frame 34. The second rack 32 further includes a fixing portion 38 protruding outward from one side of the outer wall frame 34 to fix the second rack 32 to the door 14 or the lower rack 30*b*.

<Controller and Related Configuration>

Figure 10:
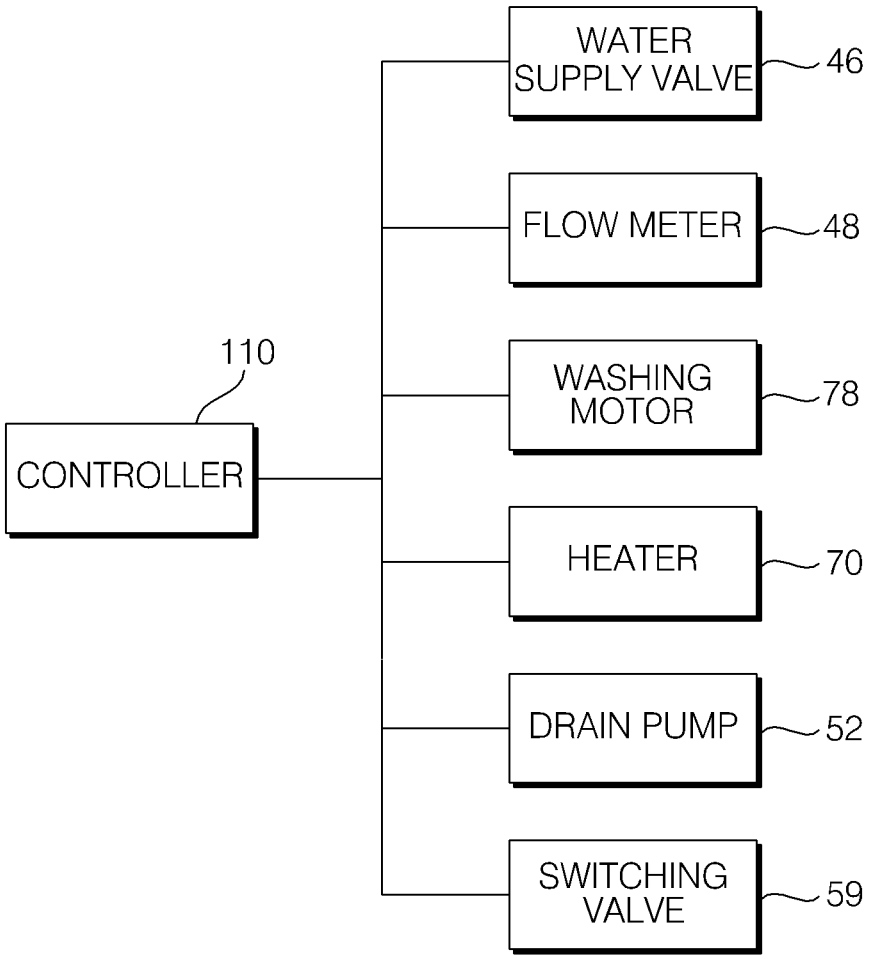
FIG. 10 is a block diagram illustrating a controller and a related configuration according to an embodiment of the present invention.

FIG. 10 is a block diagram illustrating a controller and a related configuration according to an embodiment of the present invention.

Hereinafter, the controller according to an embodiment of the present invention and the related configuration will be described with reference to FIG. 10.

The controller 110 may receive the flow rate of the washing water measured by the flow meter 48, and control the water supply valve 46, the washing motor 78 of the washing pump 60, the heater 70, the drain pump 52, and the switching valve 59 to perform washing for the washing target. The controller 110 may perform each process according to the washing course selected by user.

The controller 110 may control the washing motor 78 and the heater 70 to operate separately or simultaneously according to each process. The controller 110 may differently control the rotational speed of the impeller 80 rotated by the washing motor 78 according to each process.

<Control Method>

Figure 11:
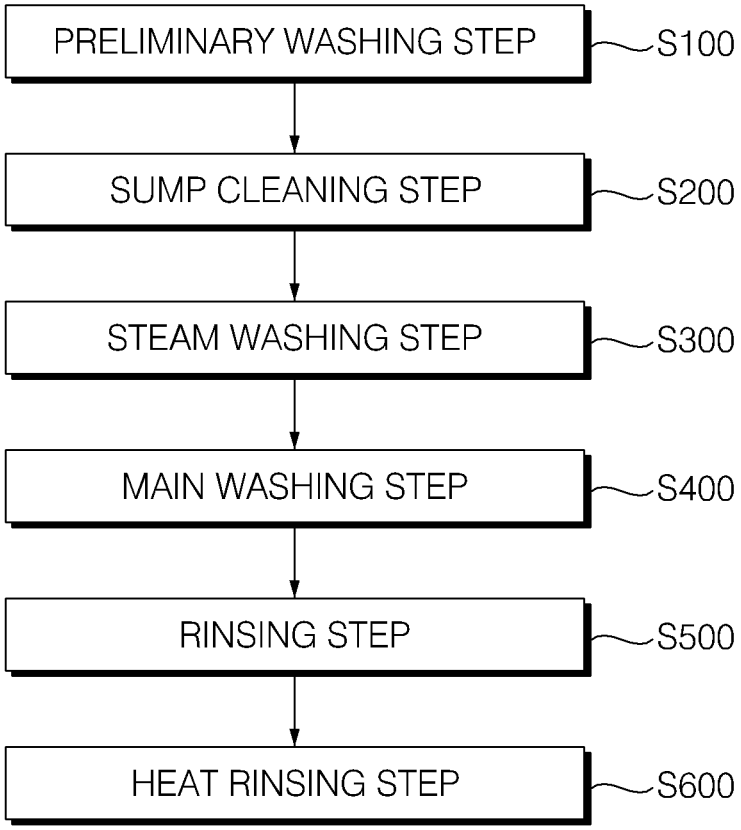
FIG. 11 is a flowchart of a method of controlling a dishwasher according to an embodiment of the present invention.
Figure 12:
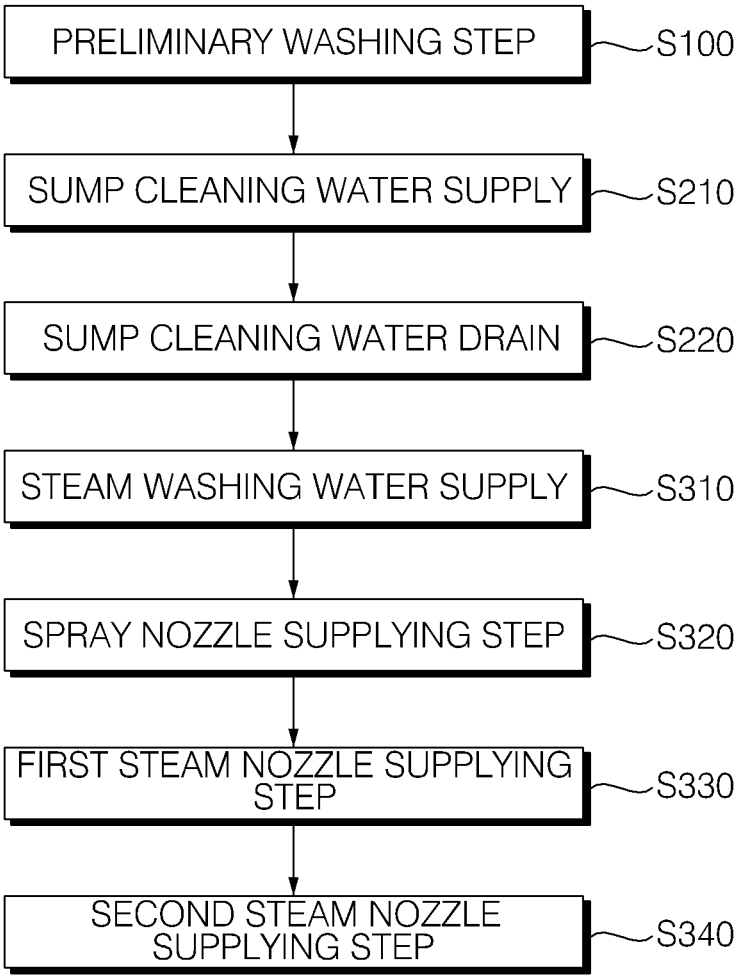
FIG. 12 is a flowchart illustrating a sump washing step and a steam washing step in a method of controlling a dishwasher according to an embodiment of the present invention.

FIG. 11 is a flowchart of a method of controlling a dishwasher according to an embodiment of the present invention. FIG. 12 is a flowchart illustrating a sump washing step and a steam washing step in a method of controlling a dishwasher according to an embodiment of the present invention.

Hereinafter, the method of controlling a dishwasher according to an embodiment of the present invention will be described with reference to FIGS. 11 and 12.

The dishwasher control method according to the present invention may sequentially perform a preliminary washing step s100, a steam washing step s300, a main washing step s400, a rinsing step s500, and a heat rinsing step s600.

In the preliminary washing step S100, the washing water is sprayed onto the washing target to remove the dirt attached to the washing target. In the preliminary washing step S100, the controller 110 controls the water supply valve 46 to supply the washing water from an external water source into the sump 40. After the water supply, the controller 110 operates the washing pump 60 to pump the washing water inside the sump 40 and controls the switching valve 59 to spray the washing water through at least one of the plurality of spray nozzles 20, 22, 24. The washing water sprayed through at least one of the plurality of spray nozzles 20, 22, 24 drops the dirt attached to the washing target onto the bottom 16*b* of the tub 16 so that the filter 42 collects the dropped dirt. After spraying the washing water, the controller 110 operates the drain pump 52 to drain the washing water in the sump 40 to the outside.

In this embodiment, the preliminary washing step S100 may be performed at least once or more variously, depending on the embodiment.

The steam washing step S300 is a process in which heated washing water is sprayed onto the washing target and steam is applied to the washing target, thereby achieving sterilization and expanding the dirt attached to the washing target. In the steam washing step S300 according to the present embodiment, the steam and the high-temperature washing water may be simultaneously sprayed. In this case, the steam sprayed through the steam nozzle 100 may be applied to the washing target, thereby achieving sterilization and expanding the dirt attached to the washing target. The high-temperature washing water discharged through the steam nozzle 100 flows into the bottom of the tub 16 so that the bottom 16*b* of the tub 16 can be sterilized or the dust attached to the bottom of the tub 16 can be removed.

A detailed explanation of the steam washing step S300 will be described later with reference to FIG. 9 and the following figures.

A main washing step S400 is a step of heating the washing target by spraying the heated washing water onto the washing target and removing the dirt attached to the washing target. In the main washing step S400, the controller 110 controls the water supply valve 46 to supply washing water from the external water source to the sump 40. Thereafter, the heater 70 is controlled to heat the washing water, and the washing pump 60 is operated to spray the heated washing water through at least one of the plurality of the spray nozzles 20, 22, and 24. At this time, a dispenser (not shown) disposed in the door 14 is opened, and detergent is mixed with the washing water flowing in the tub 16, so that the washing target can be washed. Thereafter, the drain pump 52 is operated to drain the washing water in the sump 40 to the outside.

The rinsing step S500 is a step of removing residual dirt adhered to the washing target or rinsing the washing target that was washed with the washing water mixed with the detergent. In the rinsing step S500, the controller 110 controls the water supply valve 46 to supply the washing water from the external water source to the sump 40, and then operates the washing pump 60 to spray the washing water through the plurality of spray nozzles 20, 22, 24. Thereafter, the drain pump 52 is operated to drain the washing water in the sump 40 to the outside. In the rinsing step S500, the rinsing detergent may be mixed with the washing water.

The heat rinsing step S600 is a step of heating the washing target by spraying heated washing water onto the washing target. In the heat rinsing step S600, the controller 110 controls the water supply valve 46 to supply the washing water from the external water source to the sump 40, and then controls the heater 70 to heat the washing water. Thereafter, the washing pump 60 is operated to spray the heated washing water through at least one of the plurality of spray nozzles 20, 22 and 24, and then the drain pump 52 is operated to discharge the washing water in the sump 40 to the outside.

According to an embodiment, the steam washing step s300 can be performed between the main washing step s400 and the rinsing step s500, between the rinsing step s500 and the heat rinsing step s600, or after the heat rinsing step s600.

<Steam Washing Step>

The steam washing step s300 according to the present embodiment is a step of being performed after the preliminary washing step s100, and may be performed after the preliminary washing water s190 which is the final step of the preliminary washing step s100.

The steam washing step S300 includes a steam washing water supply step S310 of receiving washing water to be heated, a spray nozzle supplying step S320 of operating the heater 70, operating the washing motor 78 to rotate at a first set rotation speed SRS1 or higher and supplying washing water to the plurality of the spray nozzles 20, 22, 24, a first steam nozzle supplying step S330 of operating the heater 70, stopping or rotating the washing motor 78 at a second set rotational speed or lower to supply steam or washing water to the steam nozzle 100, and a second steam nozzle supplying step S340 of stopping the heater 70, and rotating the washing motor 78 at a second set rotational speed or lower to supply steam or washing water to the steam nozzle 100.

A sump cleaning step s200 of cleaning the sump 40 may be added between the preliminary washing step s100 and the steam washing step s300. The sump cleaning step S200 may be performed with an operation of supplying the washing water from the external water source to the sump 40 and draining the washing water.

That is, the controller 110 performs a sump cleaning water supply (s210), and supplies the washing water to the sump 40 from the external water source. The controller 110 opens the water supply valve 46 so that the washing water is introduced from the external water source into the sump 40 through the water supply pipe 44. The controller 110 may close the water supply valve 46, when it is determined that a proper amount of washing water is supplied to the sump 40 at the flow rate of the washing water measured by the flow meter 48.

When the sump cleaning water supply (s210) is completed, the controller 110 performs a sump cleaning water drain (s220). In the sump cleaning water drain (s220), the controller 110 operates the drain pump 52 to drain the cleaning water supplied to the sump 40 to the outside through the drain pipe 50. At this time, the dirt in the sump 40 is discharged to the outside together with the washing water through the drain pipe 50, so that the inside of the sump 40 can be cleaned. The controller 110 stops the washing pump 60 when it is sensed that all the washing water in the sump 40 is drained through the drain motor of the drain pump 52.

In the sump cleaning step s200, the controller 110 does not operate the washing motor 78 of the washing pump 60 and the heater 70. The sump cleaning step s200 is a step of removing the dirt in the sump 40. The cleaning water is supplied to the sump 40 and then drained directly to remove the dirt in the sump 40. However, the above described sump cleaning step s200 may be omitted, and the steam washing step s300 can be performed immediately after the preliminary cleaning step s100.

After the sump cleaning water drain s220, the controller 110 may perform the steam washing water supply (S310).

In the steam washing water supply (S310), the controller 110 opens the water supply valve 46 to supply the washing water to the sump 40 from the external water source. When the controller 110 opens the water supply valve 46, the washing water supplied from the external water source flows into the sump 40 through the water supply pipe 44. The controller 110 closes the water supply valve 46 when it is determined that a proper amount of washing water is supplied to the sump 40 at the flow rate of the washing water measured by the flow meter 48.

The water level of the washing water supplied to the sump 40 during the steam washing water supply (s310) may be formed lower than the water level of the washing water supplied to the sump 40 during the water supply in the plurality of preliminary washing step s100, the main washing step s400, the rinsing step s500, and the heat rinsing step s600.

In addition, the water level of the washing water supplied to the sump 40 during the steam washing water supply (s310) may be lower than the water level of the washing water supplied to the sump 40 at the sump cleaning water supply (s210). The amount of washing water supplied to the sump 40 during the steam washing water supply (s310) is sufficient to fill the housing 62 of the washing pump 60. When the amount of the washing water supplied to the sump 40 during the steam washing water supply (s310) is introduced into the housing 62 of the washing pump 60, the water level of may be lower than the lowest end of the steam discharge pipe 82.

Even if the steam washing water supply (s310) is completed, there may be no washing water inside the housing 62 of the washing pump 60 or very little washing water can be stored.

When the steam washing water supply (s310) is completed, the controller 110 controls the switching valve 59 so that the washing pump 60 is connected to all of the plurality of the spray nozzles 20, 22, 24 and performs the spray nozzle supplying step S320. The supply nozzle supplying step s320 is a step of circulating the hot water by operating the heater 70 and the washing motor 78, and the washing water to be generated into steam may be preheated through the above process.

In the spray nozzle supplying step S320, the controller 110 controls the switching valve 59 so that the washing water can be supplied to all of the plurality of spray nozzles 20, 22, 24. The controller 110 operates the heater 70 to heat the washing water flowing inside the housing 62 of the washing pump 60. The controller 110 operates the washing motor 78 to supply the washing water inside the housing 62 of the washing pump 60 to the plurality of spray nozzles 20, 22, 24. The washing water sprayed through all of the plurality of spray nozzles 20, 22 24 is applied to the washing target, and then flows to the bottom 16*b* of the tub 16 and is collected in the sump 40. The washing water collected in the sump 40 flows to the washing pump 60 again and is heated and pumped, and thus, the washing water can be preheated.

When the controller 110 operates the washing motor 78, the check valve 56 is opened and the washing water stored in the sump 40 is filled in the housing 62 through the water collecting pipe 54 and the washing water inflow pipe 86, and then, may be pumped to the plurality of spray nozzles 20, 22, 24 through the washing water outflow pipe 84.

The controller 110 operates the washing motor 78 to rotate at the first set rotation speed SRS1 or higher at the spray nozzle supplying step s320. Here, the first set rotation speed SRS1 may be a rotation speed at which the washing motor 78 operates to allow the washing water having the first set pressure SP1 or higher to flow into the valve body 92 of the selector valve 90. Thus, when the washing motor 78 is rotated at the first set rotational speed SRS1 SP1 or higher, the inlet of the valve seat 96 of the selector valve 90 is in close contact with the valve ball 98 and is closed.

Therefore, the washing water supplied through the washing pump 60 at the spray nozzle supplying step s320 may be supplied to the plurality of spray nozzles 20, 22, 24 without being supplied to the steam nozzle 100.

The spray nozzle supplying step S320 may be performed for a set time. Accordingly, the controller 110 may perform the first steam nozzle supplying step S330, when the spray nozzle supplying step S320 is performed and the set time is elapsed.

At the first steam nozzle supplying step S330, the controller 110 allows the steam or the high-temperature washing water heated by the heater 70 in the washing pump 60 to be supplied to the steam nozzle 100. That is, the controller 110 operates the heater 70 to heat the washing water flowing inside the housing 62 of the washing pump 60. The controller 110 stops the washing motor 78 or operates at a second set rotational speed or lower so that the washing water in the housing 62 of the washing pump 60 is supplied to the steam nozzle 100.

Here, when the washing motor 78 is operated at a rotational speed equal to or lower than the second set rotational speed SRS2, the washing water may flow into the valve body 92 of the selector valve 90 at the first set pressure SP1 or lower. Accordingly, at the first steam nozzle supplying step S330, the washing water or steam having the first set pressure SP1 or less flows into the valve body 92 of the selector valve 90, so that the selector valve 90 is opened. When the washing motor 78 is rotated at the second set rotational speed SRS2 or less, the valve ball 98 of the selector valve 90 is disposed spaced apart from the inlet of the valve seat 96 and the selector valve 90 may be opened.

Accordingly, at the first steam nozzle supplying step S330, the steam or the washing water of high temperature heated by the washing pump 60 may be supplied to the steam nozzle 100. At this time, the controller 110 may control the switching valve 59 so that the washing pump 60 may be connected to the top spray nozzle 24 among the plurality of spray nozzles 20.

The steam or a part of the washing water may be supplied to the spray nozzle at the first steam nozzle supplying step S330 as well. However, at the first steam nozzle supplying step S330, since the washing motor 78 does not operate or rotates at the second set rotational speed or lower and the switching valve 59 connects the washing pump 60 and the top spray nozzle 24, most of the steam or the washing water may be supplied to the steam nozzle 100.

The spray nozzle supplying step s320 and the first steam nozzle supplying step s330 may be repeated a plurality of times. That is, it is possible that the spray nozzle supplying step S320 and the first steam nozzle supplying step S330 are performed, and then the spray nozzle supplying step S320 and the first steam nozzle supplying step S330 are performed again.

When the first steam nozzle supplying step S330 is performed and the set time is elapsed, the controller 110 stops the operation of the heater 70 and performs the second steam nozzle supplying step S340 for rotating the washing motor 78 at the second set rotation speed SRS2 or lower. Here, the set time during which the first steam nozzle supplying step S330 is performed and the set time during which the spray nozzle supplying step S320 is performed may be different from each other.

A stopping step (not shown) for stopping the operation of the heater 70 and the washing motor 78 may be performed between the first steam nozzle supplying step s330 and the second steam nozzle supplying step s340. Here, the stopping step may proceed for a very short time so as not to cool the heated steam or washing water in the washing pump 60.

At the second steam nozzle supplying step S340, the controller 110 may supply the steam or washing water heated at the first steam nozzle supplying step S330 to the steam nozzle 100. That is, the controller 110 stops the operation of the heater 70 at the second steam nozzle supplying step S340, and supplies the steam or the high temperature washing water generated at the first steam nozzle supplying step S330 to the steam nozzle 100.

The second steam nozzle supplying step S340 may proceed for a shorter time than the first steam nozzle supplying step S330. At the second steam nozzle supplying step S340, the heater 70 is not operated so that the overheat of the heater 70 can be prevented. However, since the temperature of the washing water or steam in the washing pump 60 may be lowered, the second steam nozzle supplying step S340 may be performed for a shorter time than the first steam nozzle supplying step S330.

In the second steam nozzle supplying step S340 as well, the controller 110 may rotate the washing motor 78 at the second set rotational speed SRS2 or lower so that the washing water or steam in the washing pump 60 is supplied to the steam nozzle 100.

In addition, the controller 110 may control the switching valve 59 so that the washing pump 60 and the top spray nozzle 24 communicate with each other.

The first steam nozzle supplying step S330 and the second steam nozzle supplying step S340 according to the present embodiment may be repeated a plurality of times. That is, the first steam nozzle supplying step s330 and the second steam nozzle supplying step s340 are performed, and then the first steam nozzle supplying step s330 and the second steam nozzle supplying step s340 may be performed again.

However, the process of repeatedly performing the spray nozzle supplying step s320 and the first steam nozzle supplying step s330 is separately performed from the process of repeatedly performing the first steam nozzle supplying step s330 and the second steam nozzle supplying step s340. That is, the spray nozzle supplying step s320, the first steam nozzle supplying step s330, and the second steam nozzle supplying step s340 are not repeatedly performed, but the first steam nozzle supplying step s330 and the second steam nozzle supplying step s340 performed last are repeatedly performed again, after the spray nozzle supplying step s320 and the first steam nozzle supplying step s330 are repeatedly performed.

When the steam washing step S300 is completed, the controller 110 may operate the drain pump 52 to drain the washing water stored in the sump 40 to the outside and perform the main wash step S400. That is, when the second steam nozzle supplying step S340 is completed, the washing water stored in the sump 40 may be discharged to the outside and the main washing step S400 may be performed. However, it is also possible to omit a separate drain step between the steam washing step S300 and the main washing step S400.

The steam sprayed by the steam nozzle 100 may be sprayed toward the second rack 32 at the first steam nozzle supplying step S330 and the second steam nozzle supplying step s340 according to the present embodiment. In this case, it is also possible to perform intensive washing by the steam for the washing target which is placed in the second rack 32.

The steam washing step S300 according to the present embodiment can be modified in a range that the heater 70 is operated to generate steam and the washing motor 78 rotates the impeller 80 at the second set rotation speed SRS2 or lower.

The steam washing step s300 according to another embodiment may include the steps of i) stopping the washing motor 78, operating the heater 70, heating the washing water in the washing pump 60 to wash the steam, ii) stopping the heater 70, iii) stopping the heater 70, and rotating the impeller 80 at the second set rotational speed SRS2 or lower by the washing motor 78, and iv) operating the heater 70, and rotating the impeller 80 at the second set rotational speed SRS2 or lower by the washing motor 78.

The steam washing step s300 according to another embodiment may include the steps of i) stopping the washing motor 78, operating the heater 70, heating the washing water in the washing pump 60 to wash the steam, ii) stopping the heater 70, iii) operating the heater 70, and rotating the impeller 80 at the second set rotational speed SRS2 or lower by the washing motor 78, and iv) operating the heater 70, and rotating the impeller 80 at the second set rotational speed SRS2 or lower by the washing motor 78.

In addition, the first steam nozzle supplying step S330 may be performed after the spray nozzle supplying step s320. However, in this case, the step of rotating the impeller 80 by the washing motor 78 so that the washing water can flow from the sump 40 into the washing pump 60 may be preceded.

According to the dishwasher of the present invention and the control method thereof, one or more of the following effects can be obtained.

First, in the process of supplying steam or high-temperature washing water to the steam nozzle, the heater which heats the washing water existing in the washing pump is periodically operated to prevent the heater from being overheated by the continuous operation of the heater, and the life of the heater can be extended.

Secondly, in the process of supplying steam or high-temperature washing water to the steam nozzle, the impeller in the washing pump is periodically operated to prevent the heater from overheating, and the life of the heater can be extended.

Third, the rotating condition of the impeller in which the ball valve is blocked and the rotating condition of the impeller in which the ball valve is not blocked can be distinguished, the rotating speed of the impeller can be varied according to the washing step, and the steam or high-temperature washing water can be supplied to the steam nozzle as well during the rotation of the impeller, thereby increasing the efficiency of dish washing.

Fourth, a separate tableware rack can be disposed in the area to which the steam or high-temperature washing water is sprayed through the steam nozzle, thereby effectively washing the target requiring intensive washing by steam spraying.

Fifth, when the steam is generated, the washing pump is connected to the spray arm disposed in the uppermost end to minimize the loss of steam through the washing water circulating flow path.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

What is claimed is:

1. A method of controlling a dishwasher that includes a tub defining a washing chamber, a sump configured to store washing water, a steam nozzle configured to supply steam to the washing chamber, a spray nozzle configured to supply washing water to the washing chamber, a washing pump including a housing and an impeller rotatably disposed in an upper chamber of the housing, the washing pump being configured to supply steam to the steam nozzle or to supply washing water to the spray nozzle, a heater disposed in the washing pump and configured to heat washing water in the washing pump, a steam supply pipe connecting the upper chamber to the steam nozzle, a washing water supply pipe connecting the upper chamber to the spray nozzle, and a selector valve disposed at the steam supply pipe and configured to open and close a supply path, the selector valve including (i) a valve body that defines the supply path and has an inlet and an outlet disposed higher than the inlet and (ii) a valve ball disposed inside the valve body, the selector valve being configured to close the supply path based on the valve ball being positioned at the outlet of the valve body, wherein the supply path is configured to be closed based on a rotational speed of the impeller being greater than or equal to a first set rotational speed, the method comprising:

supplying washing water to the sump;

rotating the impeller by a washing motor to supply washing water from the sump to the washing pump;

performing a first steam supplying operation that includes operating the heater and supplying steam generated in the washing pump to the steam nozzle through the supply path; and performing a second steam supplying operation that includes stopping operation of the heater and supplying steam in the washing pump to the steam nozzle by rotating the impeller at a second set rotational speed less than the first set rotational speed by the washing motor, the supply path being configured to be opened based on the rotational speed of the impeller being less than the first set rotational speed.

2. The method of claim 1, wherein the dishwasher further includes a plurality of spray nozzles configured to spray washing water to an inside of the dishwasher, and wherein the method further comprises:

based on rotating the impeller at a rotational speed greater than or equal to the first set rotational speed by the washing motor, supplying washing water from the sump to an inside of the washing pump and supplying washing water from the washing pump to at least one of the plurality of spray nozzles.

3. The method of claim 2, wherein the first steam supplying operation further comprises:

rotating the impeller while operating the heater to heat washing water in the inside of the washing pump.

4. The method of claim 3, further comprising:

repeating each of rotating the impeller and operating the heater.

5. The method of claim 2, wherein the plurality of spray nozzles are vertically arranged in the dishwasher and connected to the washing pump, and wherein the method further comprises supplying, by rotating the impeller, washing water from the washing pump to all of the plurality of spray nozzles.

6. The method of claim 1, further comprising:

stopping operation of the heater and operation of the washing motor before performing the second steam supplying operation.

7. The method of claim 1, wherein operating the heater comprises:

operating the heater while rotating, by the washing motor, the impeller at the second set rotational speed.

8. The method of claim 1, wherein the second steam supplying operation is performed based on stopping operation of the heater.

9. The method of claim 1, further comprising:

repeating the first steam supplying operation and the second steam supplying operation.

10. The method of claim 1, wherein the dishwasher further includes a plurality of spray nozzles vertically arranged in the dishwasher and configured to be connected to the washing pump, and wherein the first steam supplying operation further comprises connecting the washing pump to an uppermost spray nozzle among the plurality of spray nozzles.

11. The method of claim 1, wherein the valve body has a cylindrical shape, and the valve ball is configured to move along the valve body between the inlet and the outlet of the valve body, and wherein the selector valve is configured to open the supply path by the valve ball moving away from the outlet of the valve body based on the rotational speed of the impeller being less than the first set rotational speed.

12. The method of claim 1, wherein the washing motor is disposed above an upper surface of the housing and below the selector valve.

13. The method of claim 12, wherein the valve body is inclined upward with respect to the upper surface of the housing and extends from the inlet to the outlet.

14. The method of claim 1, wherein the valve ball is configured to:

be positioned at the outlet of the valve body to thereby close the supply path based on the rotational speed of the impeller being greater than or equal to the first set rotational speed, and be positioned at the inlet of the valve body to thereby open the supply path to the steam nozzle based on the rotational speed of the impeller being less than the first set rotational speed.

15. The method of claim 1, wherein the selector valve further includes a plurality of valve ribs that are disposed at the inlet of the valve body and protrude radially inward from an inner surface of the valve body, the plurality of valve ribs being spaced apart from one another in a circumferential direction of the valve body and configured to contact the valve ball based on the rotational speed of the impeller being less than the first set rotational speed.

* * * * *